US008256400B2

(12) United States Patent
Tisch

(10) Patent No.: US 8,256,400 B2
(45) Date of Patent: Sep. 4, 2012

(54) PISTON PUMP

(75) Inventor: Siegfried Tisch, Gerlingen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 853 days.

(21) Appl. No.: 12/305,716

(22) PCT Filed: May 31, 2007

(86) PCT No.: PCT/EP2007/055285

§ 371 (c)(1),
(2), (4) Date: Dec. 19, 2008

(87) PCT Pub. No.: WO2007/147707

PCT Pub. Date: Dec. 27, 2007

(65) Prior Publication Data

US 2011/0139125 A1 Jun. 16, 2011

(30) Foreign Application Priority Data

Jun. 23, 2006 (DE) ..... 10 2006 028 851

(51) Int. Cl.
*F02M 41/00* (2006.01)
*F02M 37/04* (2006.01)

(52) U.S. Cl. ..... 123/450; 123/508

(58) Field of Classification Search ..... 123/495, 123/450, 508, 198 C; 417/273, 462, 221, 417/415, 364, 470; 384/447, 461
See application file for complete search history.

(56) References Cited

U.S. PATENT DOCUMENTS

| | | | | |
|---|---|---|---|---|
| 4,861,234 | A * | 8/1989 | Joy et al. | 417/273 |
| 5,348,382 | A | 9/1994 | Ebaugh et al. | |
| 2003/0145835 | A1 * | 8/2003 | Djordjevic | 123/495 |

FOREIGN PATENT DOCUMENTS

| | | |
|---|---|---|
| DE | 19650246 | 6/1998 |
| DE | 19650274 | 6/1998 |
| DE | 19712872 | 10/1998 |
| DE | 19827926 | 1/1999 |
| DE | 19813322 | 9/1999 |
| DE | 19830890 | 1/2000 |
| DE | 19918020 | 10/2000 |
| DE | 10013269 | 9/2001 |
| DE | 10117108 | 10/2002 |
| DE | 10208574 | 6/2003 |
| EP | 0699836 | 3/1996 |
| EP | 1247711 | 10/2002 |

* cited by examiner

*Primary Examiner* — Stephen K Cronin
*Assistant Examiner* — Sherman Manley
(74) *Attorney, Agent, or Firm* — Volpe and Koenig, P.C.

(57) ABSTRACT

A piston pump, especially for supplying high-pressure fuel to a direct-injection internal combustion engine, including a pump housing (2) and a drive shaft (3*a* to 3*i*) for actuating one or several pump plungers (5) which are radially oriented relative to the drive shaft in the pump housing. The drive shaft is rotatably mounted on one or several bearings (11, 31, 49) extending between a shaft inlet (15) of the pump housing and a rear housing wall (20) located opposite the shaft inlet. One bearing (11) extends between an internal surface (17) of a hollow cylindrical section (10) of the drive shaft and an external surface (18) of a journal (19) that runs from the rear housing wall into the hollow cylindrical section.

23 Claims, 7 Drawing Sheets

PISTON PUMP

BACKGROUND

The invention relates to a piston pump, especially for supplying high-pressure fuel to a direct-injection internal combustion engine with a pump housing and a drive shaft for actuating one or several pump plungers that are oriented radially relative to the drive shaft in the pump housing, wherein the drive shaft is rotatably mounted on one or several bearings that extend between a shaft inlet opening of the pump housing and rear housing wall lying opposite the shaft inlet opening.

Such piston pumps are known in various constructions in the state of the art. For example, from DE 102 08 574 A1, a radial piston pump emerges that has a lifting ring arranged on an eccentric section of the drive shaft. The drive shaft is rotatably mounted in the pump housing a ball bearing arranged in the shaft inlet opening and in a sliding bearing in the region of the rear housing wall.

In US 2003/0145835 A1, a radial piston pump with a lifting ring arranged on an eccentric section of the drive shaft is also proposed, wherein the drive shaft is here mounted rotatably in the pump housing a needle bearing arranged in the region of the rear housing wall.

Another embodiment of a piston pump emerges from DE 198 27 926 A1. Instead of the lifting ring mounted eccentrically on the drive shaft, a multiple cam revolving with the drive shaft is provided for actuating a pump plunger and the drive shaft is mounted rotatably in the pump housing by using a ball bearing arranged on the rear housing wall.

One feature that is common to the embodiments of the piston pumps noted as examples is that each of the bearings arranged in the region of the rear housing wall requires an end journal of the drive shaft that attaches to the actual drive element in the form of the eccentrically mounted lifting ring or the cam. However, the axial installation space required by the journal can be critical with respect to the pump length, especially when the piston pump is used for supplying high-pressure fuel to a direct-injection internal combustion engine and is arranged in its cylinder head region. This is currently based on the fact that, in addition to the continuous goal of constructing the internal combustion engine as compact as possible and as space saving as possible, the free space required for satisfying heightened pedestrian regulations between the engine hood of a vehicle on one side and the internal combustion engine installed in the vehicle, including its add-on parts, on the other side must absolutely be maintained. For example, maintaining these regulations can become considerably more difficult under some circumstances if a longitudinal installation of the internal combustion engine in the vehicle is provided with a piston pump of conventional construction arranged in the extension of the cylinder head, wherein, due to its overall length, this piston pump penetrates into the prescribed free space underneath the engine hood of the vehicle.

As proposed in DE 196 50 246 A1, it would indeed be possible to shorten the overall length of the piston pump by eliminating the bearing in the region of the rear housing wall. However, such a floating support of the drive element is to be classified as fundamentally unfavorable with respect to its operating stability, and for sufficient stabilization requires further measures for supporting the drive shaft. Accordingly, the piston pump of this publication also involves a configuration without its own drive shaft that can be used in all cases in connection with a lengthened camshaft already supported with sufficient stability in the internal combustion engine.

SUMMARY

Therefore, the present invention is based on the objective of developing a piston pump of the type noted above with respect to a smallest possible overall length for the best possible stability of the drive shaft bearing and simultaneous weight saving, such that the cited disadvantages or structural limitations are avoided with simple measures.

According to the invention, this objective is met in that the one bearing extends between an internal lateral surface of a hollow cylindrical section of the drive shaft and an external lateral surface of a bearing journal starting from the rear housing wall and extending into the hollow cylindrical section. Consequently, the overall length of the piston pump could be reduced considerably while simultaneously reducing the weight, such that the bearing arranged in the region of the rear housing wall is displaced into the interior of the hollow cylindrical section of the drive shaft and in this respect the journal that is typically provided and that decisively influences the overall length of the piston pump, including the attachment construction for the bearing, is eliminated. For this arrangement of the bearing, it is simultaneously guaranteed that the bearing quality of the drive shaft in the pump housing can be at least maintained relative to conventional bearings or can even be considerably improved, as will be explained below.

This improvement is achieved according to one advantageous refinement of the invention in that the one bearing and the pump plungers are positioned relative to each other in the axial direction of the drive shaft so that the radial force supported by the one bearing of at least one of the pump plungers extends without mechanical advantage within the longitudinal extent of the one bearing. Thus, it can be provided, for example, that the resulting reaction forces of one or more pump plungers arranged in the same transverse plane relative to the drive shaft extend exactly in the center through the bearing displaced into the hollow cylindrical section of the drive shaft. Through this support that is realized without mechanical advantage or indirectly of the radial forces acting on the drive shaft, non-uniform tilting of the drive shaft within its bearing caused by bearing play and also by component elasticity can be largely avoided. For the case that the entire radial load generated by the pump plungers is supported by the bearing extending in the hollow cylindrical section, in addition, another bearing for the drive shaft can be dimensioned for an especially small construction, because this other bearing is then used merely for supporting relatively small axial forces.

In another configuration of the invention, the bearing journal should be constructed in one piece with the pump housing. While this delivers a further contribution to the overall length reduction of the piston pump, it is alternatively also obvious to mount the bearing journal on the rear housing wall as a separate, optionally also hollow cylindrical component. This mounting can be realized by known bonding techniques, such as pressing, screwing in or on, welding, adhesion, soldering, riveting, etc. with possibly required sealing against lubricant leakage from the pump housing.

In one special application, the drive shaft should be rotatably connected coaxially to a camshaft used for activating intake and/or exhaust valves of the internal combustion engine. Such an arrangement of the piston pump, especially for direct fuel injection internal combustion engines, is known in connection with a common-rail injection system and is subject to the requirements on installation space limitation mentioned above to a special degree due to the position of the high-pressure fuel pump close to the engine hood.

Another, especially suitable application for the piston pump according to the invention is, for example, also the parallel arrangement of the drive shaft to a driving camshaft, wherein this can also be responsible for the charge transfer of a diesel internal combustion engine.

The rotational connection between the drive shaft and the camshaft can be constructed according to a first advantageous variant as a positive-fit coupling in which the drive shaft has a continuous longitudinal opening in which the hollow cylindrical section and internal longitudinal teeth adjacent to this section run, wherein these teeth engage with external longitudinal teeth on an end section of the camshaft facing the piston pump.

In addition, while other positive-fit couplings between the camshaft and the drive shaft could also be provided, such as, for example, in the form of a radially displaceable double D flats coupling known under the trade name "Oldham," according to a second variant of the rotational connection, the drive shaft and the camshaft shall be assembled into a rigidly connected component. In this case, there is, on one hand, the possibility of eliminating the previously mentioned additional bearing in the form of the minimally loaded axial bearing for the benefit of additional axial overall length reduction of the piston pump, because the camshaft is otherwise already supported axially in the internal combustion engine. On the other hand, there is also the possibility of axially supporting the camshaft together with the drive shaft by the additional bearing in the pump housing and eliminating the original axial bearing of the camshaft.

The term of the rigidly connected component of the camshaft and drive shaft is to be understood here to include all known non-positive fit, positive fit, or material fit connection techniques that lead to a connection that can be loaded in the axial and radial directions between the drive shaft to the camshaft. For example, among other things, it can be provided to press the drive shaft into or onto the camshaft or to screw these parts together.

As an alternative to a sliding bearing that is relatively demanding relative to the lubricant supply, in one structurally especially simple and economical configuration, the one bearing should comprise at least one radial needle bearing that is made from at least one needle assembly with a cage and needles guided therein. For the use of such a needle assembly, the internal lateral surface of the hollow cylindrical section of the drive shaft can be used as an outer raceway for the needles. According to another configuration of the invention, the outer raceway can be bounded on one side or two sides by one or two shoulders that extend inwardly in the radial direction and that are constructed integrally with the drive shaft and that are used as axial contact surfaces for the needles.

In an expansion of the needle assembly noted above, it can also be provided that the radial needle bearing is constructed as a needle sleeve with a thin-walled outer ring inserted into the internal lateral surface of the hollow cylindrical section of the drive shaft. Here, the outer ring has an internal lateral surface used as an outer raceway for the needles and also two shoulders extending inwardly in the radial direction and used as axial contact surfaces for the cage. In this case, it is sufficient to construct the internal lateral surface of the hollow cylindrical section as a fine-machined, non-hardened borehole of the drive shaft.

In the case of the radial needle bearing made at least from the needle assembly, the inner raceway for the needles shall also be formed by an inner ring drawn onto the external lateral surface of the bearing journal. This represents an economical option for the necessary fine machining and hardening of the external lateral surface of the bearing journal if the external lateral surface is provided directly as an inner raceway for the needles.

Furthermore, the needle sleeve and the thin-walled inner ring should form one component, in that the outer ring of the needle sleeve is surrounded in the axial direction by two shoulders extending outwardly in the radial direction and constructed integrally with the inner ring. However, in the case of the needle assembly, the two shoulders of the thin-walled inner ring extending outward in the radial direction can also be used as axial contact surfaces for the cage of the needle assembly.

An especially economical axial fixing of the inner ring on the bearing journal is further provided by end flattening directed outward in the radial direction of the bearing journal, wherein the flattening covers the inner ring at least partially in the radial direction. Consequently, material bulging at the end of the bearing journal generated by the flattening can have either a local, point, or segmented or also annular shape.

In one refinement of the invention, the one bearing should comprise a radial-axial bearing with the needle assembly and an axial roller bearing arranged adjacent to the needle assembly and advantageously constructed as an angular contact ball bearing, wherein the radial-axial bearing is combined to form one component constructed separately from the drive shaft and the bearing journal. With the help of such an integrated component it is possible to support the drive shaft in the radial and also axial directions at only one bearing. According to the axial loading of the drive shaft, this especially space-saving component can be constructed both for receiving axial forces in only one direction and also in both directions.

As an alternative to the component named above, there is also the possibility to construct the radial-axial bearing so that the internal lateral surface of the hollow cylindrical section of the drive shaft is used as an outer raceway for the balls and as an outer raceway for the needles. A radial installation space reduction due to the no longer required outer ring of the combined component stands as an advantage against a somewhat increased assembly expense of such a solution.

In another configuration of the invention, there are at least two bearings for the drive shaft, wherein the second bearing comprises an axial roller bearing. Here, the axial roller bearing according to a first advantageous embodiment can be constructed as a ball bearing arranged in the shaft inlet opening of the pump housing, wherein the inner raceway for the balls is formed by a peripheral groove on an external lateral section of the drive shaft extending into the shaft inlet opening. According to a second embodiment, the axial roller bearing could also be constructed as an axial needle bearing made at least from a cage and needles guided therein and can be arranged between the rear housing wall and an annular end face of the drive shaft facing the rear housing wall.

Especially in the case in which the entire radial load generated by the pump plungers is supported by the one bearing between the hollow cylindrical section of the drive shaft and the external lateral surface of the bearing journal, the axial roller bearing arranged at the second bearing can have an extremely narrow, weight-saving, and economical construction due to the relatively small axial forces on the drive shaft. Thus, it is possible, for example, in the embodiment as a ball bearing, for this to have only three balls for a lower and nevertheless sufficient load rating.

In the case of the embodiment as an axial needle bearing and for axial forces applied on two sides to the drive shaft, another axial needle bearing can also be arranged between an inner wall section of the pump housing bordering the shaft inlet opening and an annular end face of the drive shaft facing the inner wall section.

An especially space-saving and economical support of the drive shaft by a separate radial needle bearing and axial needle bearing can also be realized by the shape of the inner ring drawn on the bearing journal. Here, the inner ring should have a thin-walled construction and a diameter increasing in steps in the direction of the rear housing wall starting from the inner raceway for the needles of the radial needle bearing. Here, the inner raceway transitions into a shoulder that is used with its annular end face facing away from the rear housing wall as an axial contact surface for the cage of the radial needle bearing and that, with its external lateral surface, centers the cage of the axial needle bearing. In addition, the shoulder should transition into a collar extending outwardly in the radial direction between the rear housing wall and the annular end face of the drive shaft, wherein this collar is used as a housing-side raceway for the needles of the axial needle bearing.

It can also be provided that the inner ring has a flange extending inwardly in the radial direction and gripping over the end of the bearing journal on its end opposite the collar. Such a flange is used as a counter surface for an assembly tool and simplifies the sliding of the inner ring onto the bearing journal.

In another configuration of the invention, the drive shaft is made from a hardened roller bearing steel of type C16, 16MnCr5, C45, Cf53, C80, or 100Cr6. Here, not only is the required wear resistance in the cam-pump plunger contact guaranteed, but the mentioned materials are also excellently suited for the roller body raceways arranged optionally directly on the drive shaft.

Finally, for supplying sufficient lubricant to the one bearing, at least one borehole passing transversely through the drive shaft should be provided that opens in the region of the one bearing and that is used as a lubricant channel. While one or more such boreholes are also, in principle, suitable for supplying lubricant to sliding bearings, they represent an especially effective and economical possibility for supplying the previously mentioned roller bearing with non-pressurized sprayed oil or oil mist. The lubricant already required for lubricating the pump plungers is then led via the relatively short length of the lubricant borehole into the tribologically highly stressed region of the roller bearing.

Additional features of the invention emerge from the following description and from the drawings in which the detail of the drive region of a piston pump required for illustrating the invention is disclosed in various embodiments. The piston pump is used in all of the embodiments for supplying high-pressure fuel to a direct-injection internal combustion engine that is not shown and is attached by a flange to the cylinder head of the internal combustion engine in an extension of a camshaft for actuating intake and/or exhaust valves of the internal combustion engine.

Independent of the coupling of the drive shaft rotatably mounted in the piston pump on the camshaft, the lifting activation of one or more pump plungers mounted in the pump housing so that they can move longitudinally is always realized by one or more raised cam sections on the external lateral surface of the drive shaft. As already mentioned above, in the case of several pump plungers there is extensive structural free space, according to which the pump plungers are arranged, according to the application of the piston pump, in line in the axial direction, in a plane in the radial direction, or offset in both the axial and also radial directions. As an embodiment of the last possibility, for example, a piston pump is provided with V-shaped pump plungers that are activated by pump cams lying one behind the other in the axial direction.

BRIEF DESCRIPTION OF THE DRAWINGS

As long as not indicated otherwise, functionally identical components or features of the piston pump are provided with identical reference numbers. Shown are.

DETAILED DESCRIPTION OF THE PREFERRED EMBODIMENTS

Figure 1:
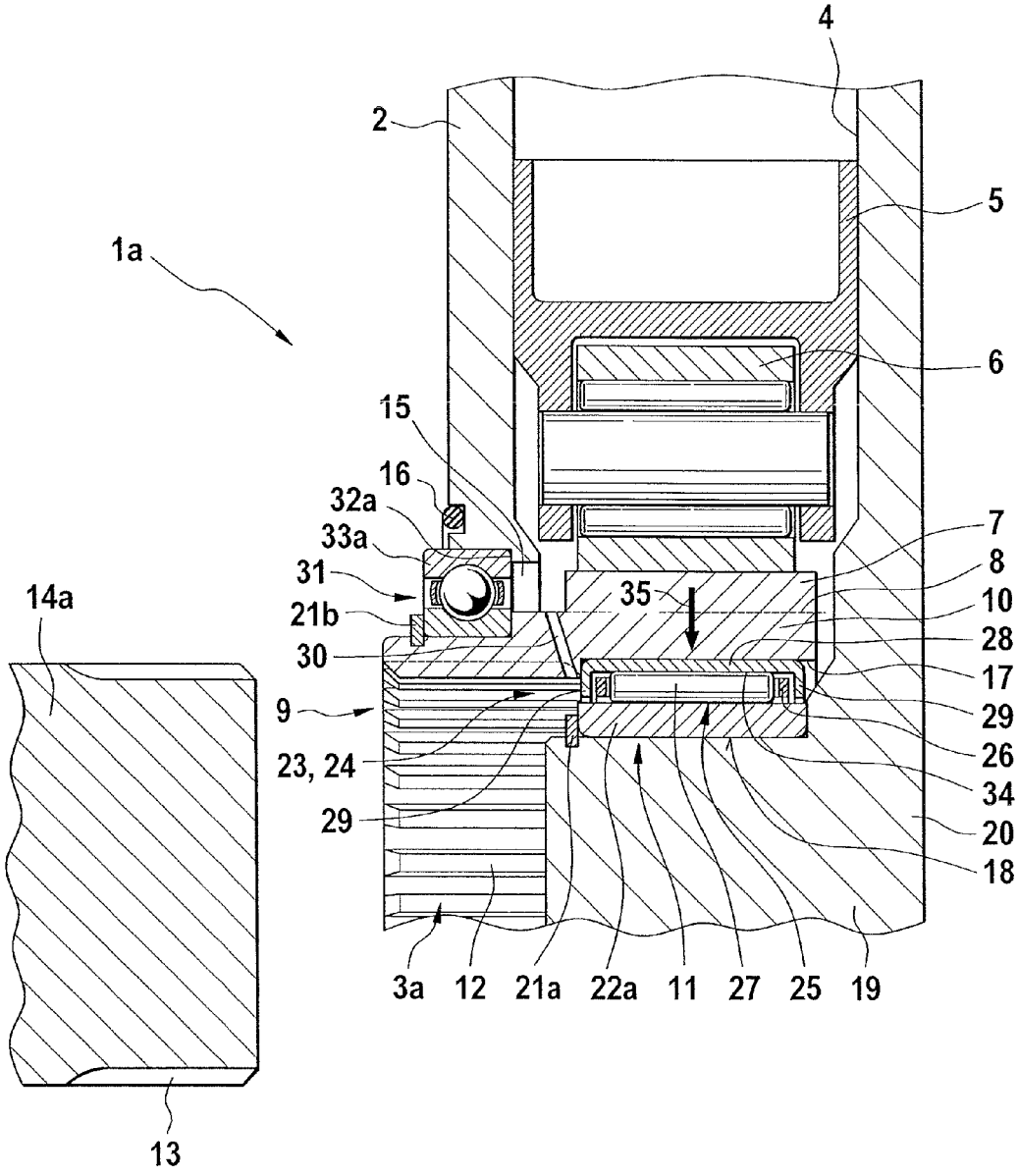
FIG. 1 is a longitudinal section view through a piston pump according to the invention according to a first embodiment.

In FIG. 1, a piston pump 1*a* is shown with a pump housing 2, a drive shaft 3*a* mounted rotatably in the pump housing 2, and also a pump plunger 5 mounted so that it can move longitudinally in a plunger guide 4 of the pump housing 2, wherein this pump plunger is oriented in the radial direction in the pump housing 2 with respect to the drive shaft 3*a*. The pump plunger 5 has a roller-mounted cam roller 6 as a low-friction pick-up element for a pump cam 7 whose raised section starts from the cam reference circle 8 drawn with dashed lines. The drive shaft 3*a* has a continuous longitudinal opening 9 with a hollow cylindrical section 10 for receiving a radial bearing 11 and internal longitudinal teeth 12 adjacent to this section. Corresponding external longitudinal teeth 13 are located on an end section facing the piston pump 1*a* on a camshaft 14*a* that has a coaxial arrangement to the drive shaft 3*a* and that drives the drive shaft 3*a* by the teeth 12 and 13 engaging each other with a positive fit. A sealing ring 16 extending around the shaft inlet opening 15 of the pump housing 2 is used for sealing the piston pump 1*a* relative to the end of the cylinder head.

The radial bearing 11 is arranged between an internal lateral surface 17 of the hollow cylindrical section 10 of the drive shaft 3*a* and an external lateral surface 18 of a bearing journal 19 that starts from a rear housing wall 20 and is here constructed integrally with the pump housing 2. The bearing 11 comprises an inner ring 22*a* drawn onto the external lateral surface 18 of the bearing journal 19 and fixed by a housing-side securing ring 21*a* and also a radial needle bearing 24 that is constructed as a needle sleeve 23 and that is made from a needle assembly 25 with cage 26 and needles 27 guided therein and also a thin-walled outer ring 28 with two shoulders 29 extending inwardly in the radial direction and used as axial contact surfaces for the cage 26. For supplying lubricant to the radial needle bearing 24, there is a borehole 30 that passes transversely through the drive shaft 3*a* and that opens in the region of the bearing 11 and that leads lubricant coming into the plunger guide 4 into the radial needle bearing 24.

For supporting possible axial forces on the drive shaft 3*a*, in this embodiment there is a second, axial bearing 31 that here comprises an axial roller bearing 33*a* supported in the shaft inlet opening 15 between a shaft-side securing ring 21*b* and a housing-side step 32*a* and constructed as a grooved ball bearing.

Because the internal lateral surface 34 of the outer ring 28 inserted into the hollow cylindrical section 10 of the drive shaft 3*a* is used as an outer raceway for the needles 27 and the grooved ball bearing is simultaneously constructed as a commercially available component, surface hardening of the drive shaft 3*a* can be limited to the pump cam 7 and can be realized, for example, in an inductive method.

The support of the drive shaft 3*a* according to the invention on the bearing journal 19 allows the radial bearing 11 and the pump plungers 5 to be positioned relative to each other in the axial direction of the drive shaft 3*a* so that a radial force that is designated with 35 and that is generated as a resulting reaction force for the lifting activation of the pump plunger 5 and that is supported by the bearing 11 extends without mechanical advantage and here centrally within the longitudinal extent of the bearing 11. In addition to the axial installation space savings, this bearing arrangement leads to a considerable increase in stiffness of the shaft support and also to a significant reduction in stress on the grooved ball bearing that now must support, in all cases, minimal axial forces and can have a corresponding narrow construction for a small required load rating.

The bearing journal 19 is constructed integrally with the pump housing 2 both in this embodiment and also in the embodiments explained below. Here, for producing the bearing journal 19 it is provided that its functional surfaces are finished for the bearing 11 with a cutting tool coming through the shaft inlet opening 15.

The embodiments according to FIGS. 2 to 8 give a—non-exhaustive—overview of other possible constructions of the piston pump according to the invention, wherein the following explanations, as far as not explained otherwise, limit the variations of the drive shaft support. Here, it is obviously up to the designer to modify, combine, or eliminate the structural features of individual embodiments, in particular, according to the number and arrangement of several pump plungers, in suitable way through expert knowledge.

Figure 2:
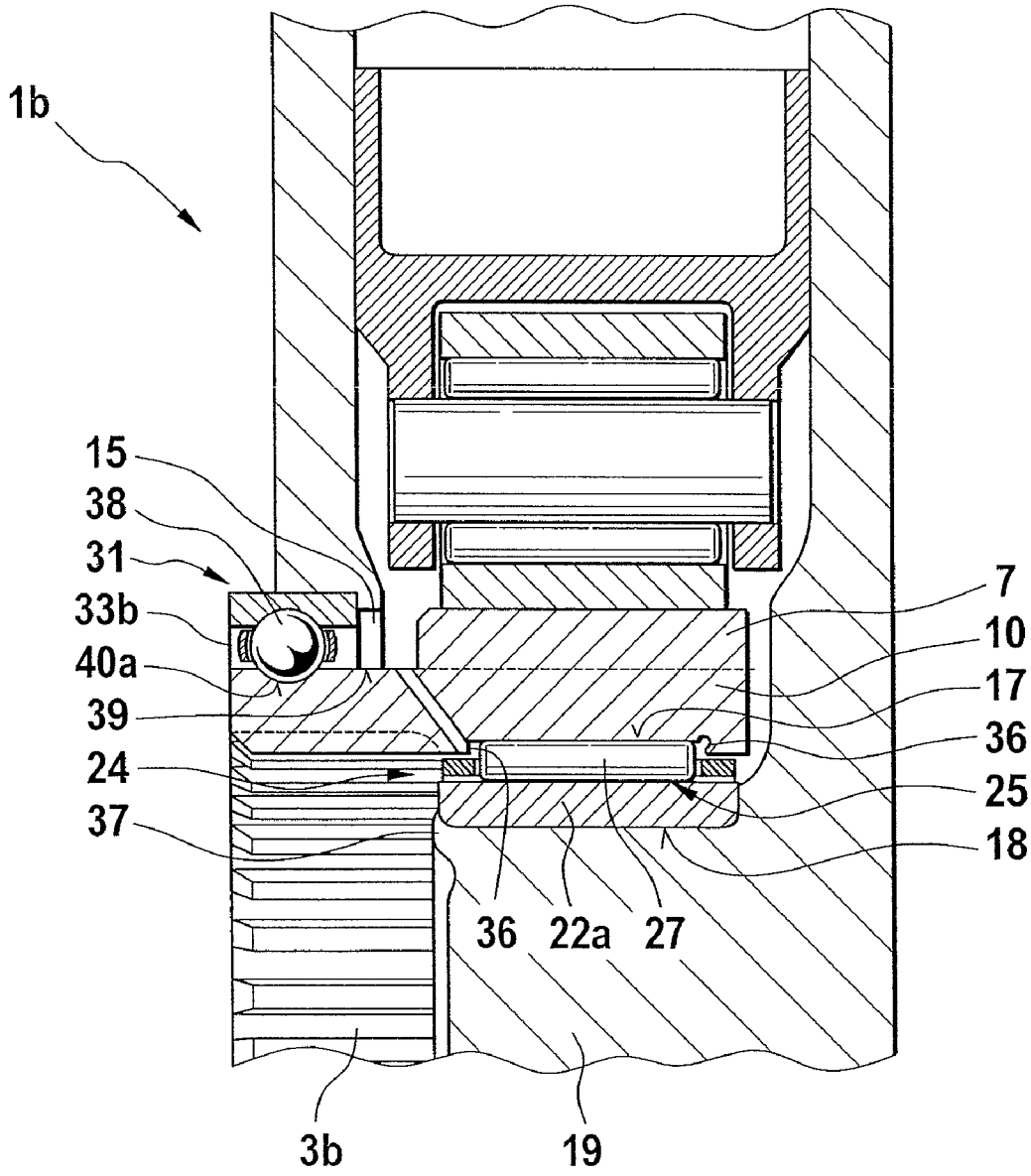
FIG. 2 is a longitudinal section view through a piston pump according to the invention according to a second embodiment.

In a piston pump 1*b* shown in FIG. 2, the radial needle bearing 24 is limited to the needle assembly 25 arranged between the bearing journal 19 and a drive shaft 3*b*, so that the internal lateral surface 17 of the hollow cylindrical section 10 directly forms the outer raceway for the needles 27. As axial contact surfaces for the needles 27, here there are two shoulders 36 extending inward in the radial direction and constructed integrally with the drive shaft 3*b*. For securing the inner ring 22*a* drawn on the external lateral surface 18 of the bearing journal 19 in the axial direction, in this case there is end flattening 37 of the bearing journal 19 directed outward in the radial direction. The material bulging generated in this way and covering the end of the inner ring 22*a* in the radial direction here has an annular construction.

The second bearing 31 arranged in the shaft inlet opening 15 of the pump housing 2 comprises, in turn, an axial roller bearing 33*b* that is constructed as a ball bearing and that is used like the axial roller bearing 33*a* according to FIG. 1 not only for supporting any axial forces, but also for centering the pump housing relative to the drive shaft 3*b* or 3*a*. However, here the axial roller bearing 33*b* is assembled into one component with the drive shaft 3*b*, in that the inner raceway for the balls 38 is formed by a peripheral groove 40*a* running on an external lateral section 39 of the drive shaft 3*b*. Because the drive shaft 3*b* is tribologically stressed not only on the pump cam 7 but also on the outer raceway for the needles 27 (internal lateral surface 17) and on the inner raceway for the balls 38 (peripheral groove 40*a*), it is especially useful to construct the drive shaft 3*b* from a case-hardened or full-hardened roller bearing steel of the types named above.

Figure 3:
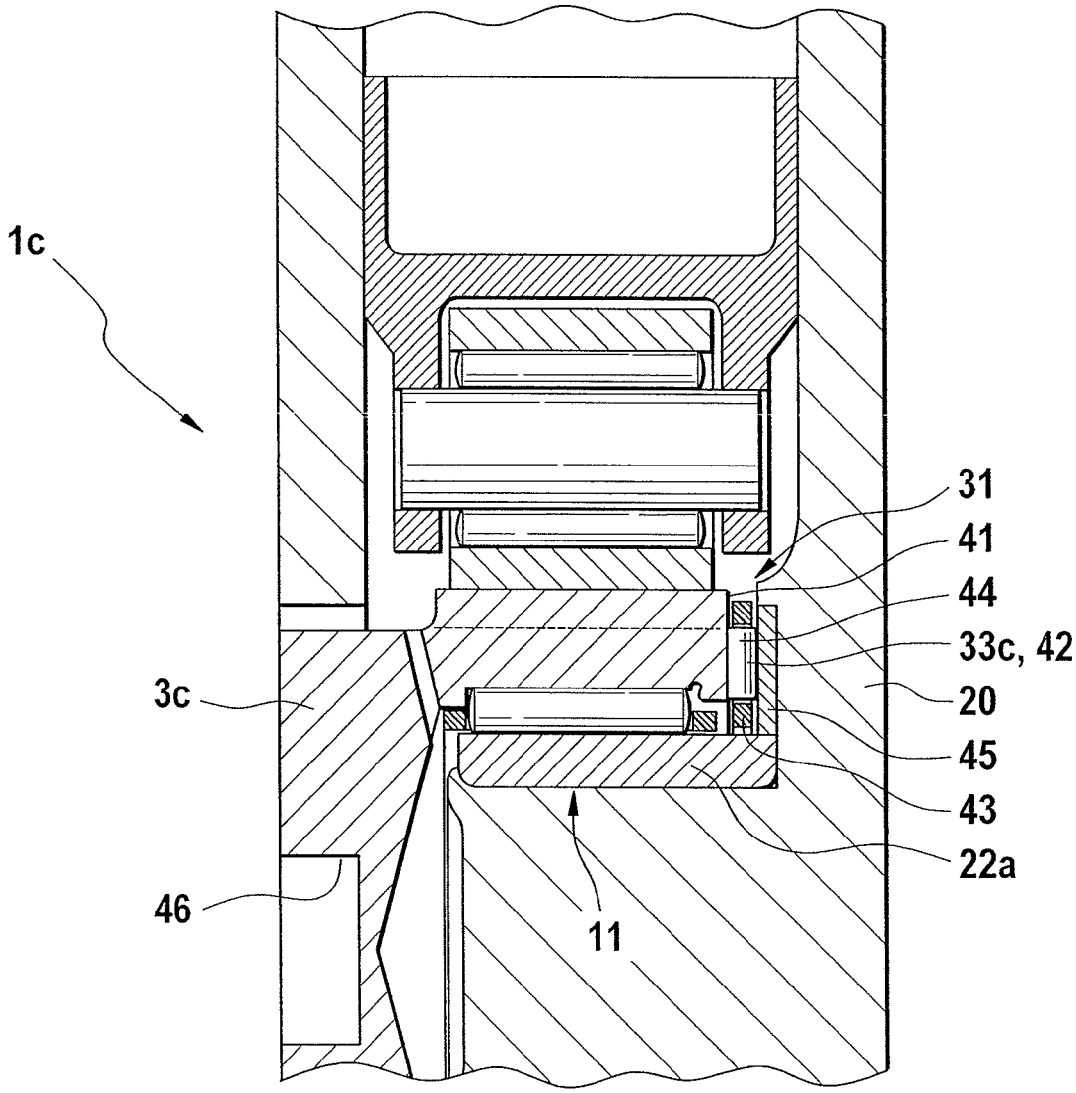
FIG. 3 is a longitudinal section view through a piston pump according to the invention according to a third embodiment.

Another embodiment of a piston pump 1*c* according to the invention is visible from FIG. 3. Its drive shaft 3*c* is mounted rotatably in the previous embodiments also on two bearings 11 and 31, wherein the second, axial bearing 31 in this case is arranged between the rear housing wall 20 and an annular end face 41 of the drive shaft 3*c* facing the rear housing wall 20. The bearing 31 comprises an axial roller bearing 33*c* in the form of a short axial needle bearing 42 also called an axial needle assembly with a cage 43 centered by the inner ring 22*a* and needled 44 guided therein and also a contact disk 45 contacting the rear housing wall 20 as a housing-side raceway for the needles 44.

Furthermore, in this case the drive shaft 3*c* is driven not only by internal longitudinal teeth but also by an end, rectangular recess 46 for receiving a double D flats coupling that equalizes a radial offset caused by component tolerances and elastic deformation between the camshaft and the drive shaft 3*c*.

Figure 4:
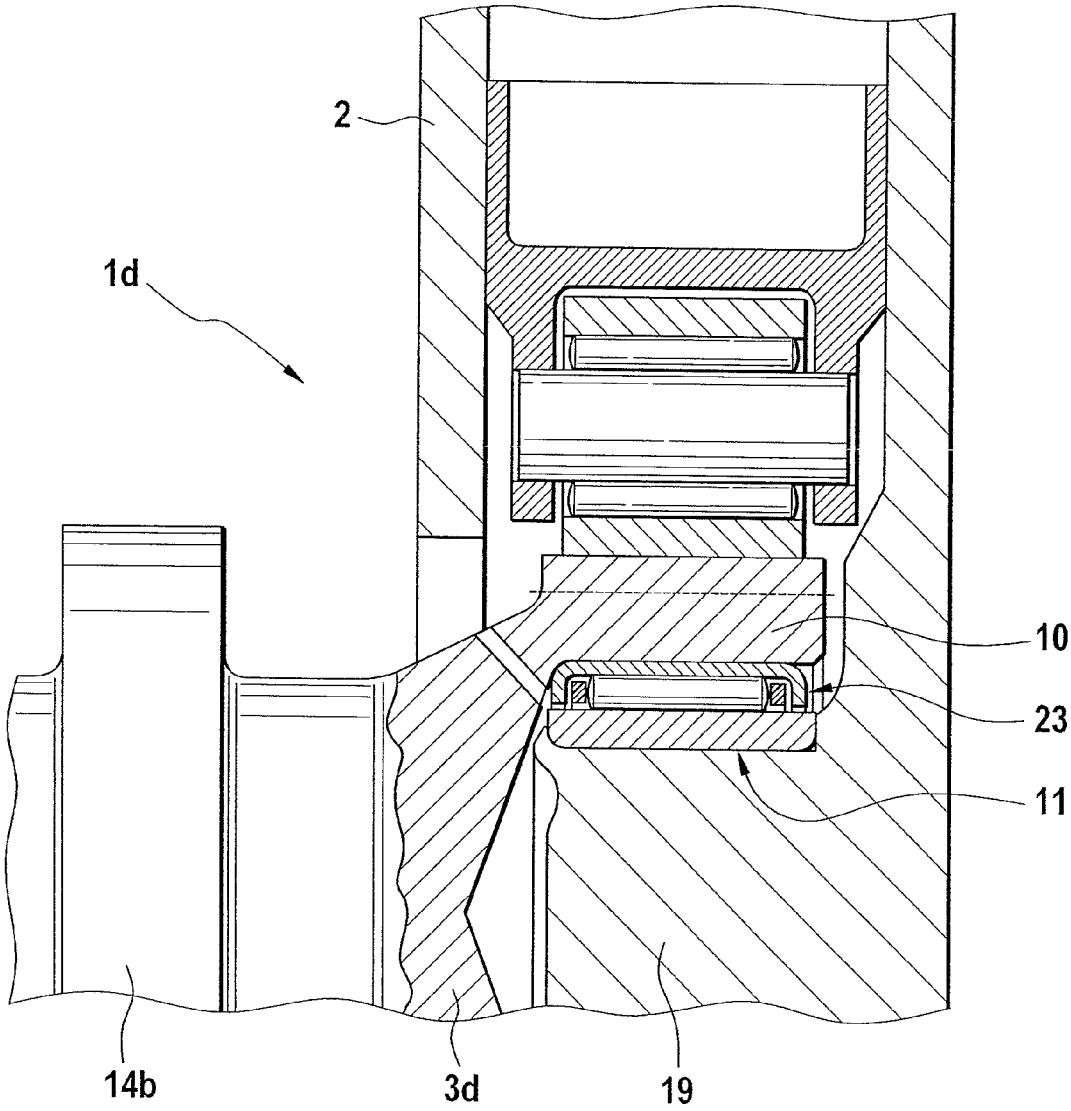
FIG. 4 is a longitudinal section view through a piston pump according to the invention according to a fourth embodiment.

In the embodiment shown in FIG. 4 for a piston pump 1*d* according to the invention, its drive shaft 3*d* is constructed integrally with a camshaft 14*b*. Because the axial position of the camshaft 14*b* is already fixed in a known way by means of an axial bearing arranged in the cylinder head of the internal combustion engine, for supporting the drive shaft 3*d* in the pump housing 2 there is merely the radial bearing 11 in the form of the needle sleeve 23 already known from FIG. 1 between the hollow cylindrical section 10 and the bearing journal 19.

Figure 5:
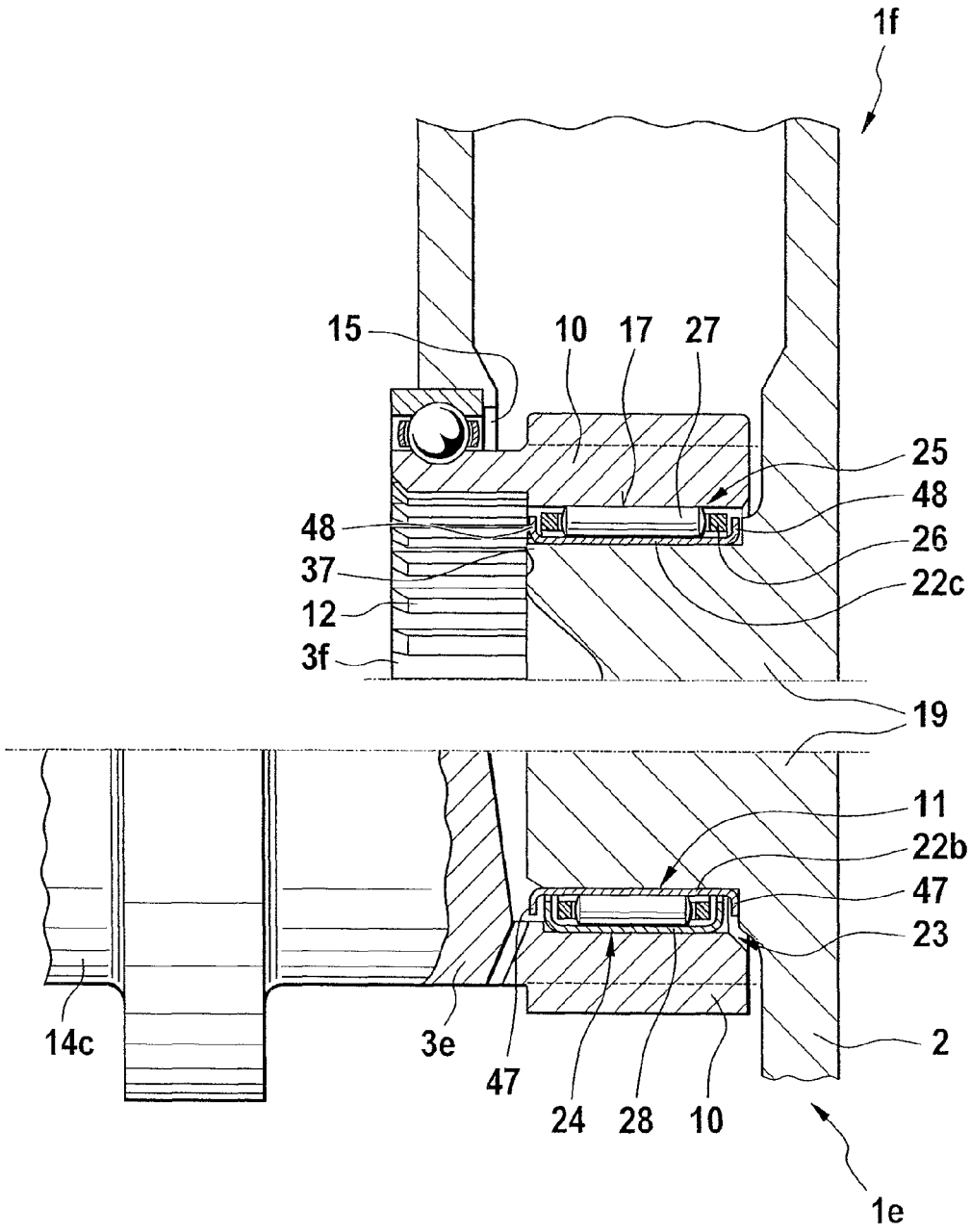
FIG. 5 is a longitudinal section view through a piston pump according to the invention according to a fifth and a sixth embodiment, each cut in half.

From the half sections shown in FIG. 5 emerge two other embodiments for piston pumps 1*e* and 1*f* according to the invention. In the lower half section in FIG. 5, a drive shaft 3*e* constructed integrally with a camshaft 14*c* is shown that is also supported only by the radial bearing 11 in the pump housing 2. The outer ring 28 of the needle sleeve 23 is here surrounded in the axial direction, however, by two shoulders 47 extending outwardly in the radial direction and constructed integrally with a thin-walled inner ring 22*b*, so that the needle sleeve 23 and the inner ring 22*b* are assembled into the radial needle bearing 24 that can be assembled as a component. For assembling the piston pump 1*e* it is provided to first insert this component into the hollow cylindrical section 10 and then to draw them onto the bearing journal 19 together with the drive shaft 3*e* or camshaft 14*c* by means of a slight displacement press fit.

The upper half section in FIG. 5 shows, in turn, a drive shaft 3*f* separate from the camshaft with internal longitudinal teeth 12 according to FIG. 1 and ball bearings arranged in the shaft inlet opening 15 according to FIG. 2. A thin-walled inner ring 22*c* drawn onto the bearing journal 19 and secured in the axial direction by the flattening 37 has, in this case, two shoulders 48 extending outwardly in the radial direction and used as axial contact surfaces for the cage 26 of the needle assembly 25. In this respect, the internal lateral surface 17 of the hollow cylindrical section 10 used here as an outer raceway for the needles 27 has a continuous cylindrical construction without the shoulders 36 shown in FIG. 2, whereby the processing the drive shaft 3*f* is simplified.

Figure 6:
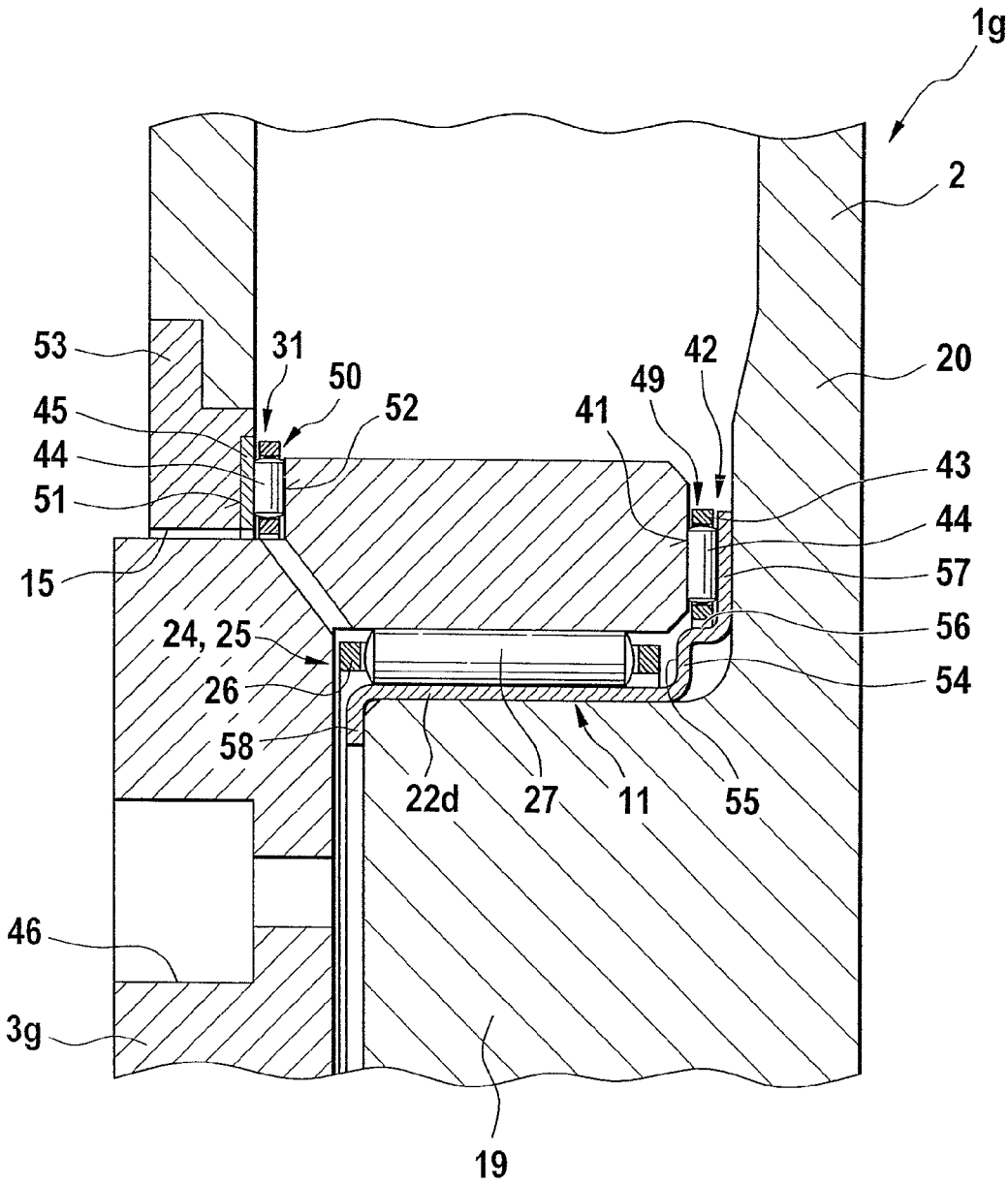
FIG. 6 is a longitudinal section view through a piston pump according to the invention according to a seventh embodiment.

In FIG. 6, a drive shaft 3*g* of a piston pump 1*g* mounted rotatably by three bearings 11, 31, and 49 is shown. The drive shaft 3*g* is driven analogous to the embodiment according to FIG. 3 by means of a double D flats coupling engaging in the rectangular recess 46, wherein for supporting two-sided axial forces, there are two axial needle bearings 42 and 50. The first axial needle bearing 42 is arranged between the rear housing wall 20 and the annular end face 41 of the drive shaft 3*g* facing this rear housing wall, while the second axial needle bearing 50 is arranged between a inner wall section 51 of the pump housing 2 bordering the shaft inlet opening 15 and an annular end face 52 of the drive shaft 3*g* facing the internal wall section 51. Here, the shaft-side raceways for the needles 44 of both axial needle bearings 42 and 50 are formed directly by the annular end faces 41 and 52. As a housing-side raceway of the axial needle bearing 50 arranged on the shaft inlet opening 15, the contact disk 45 inserted into the inner wall section 51 of the pump housing 2 is used. For assembling the contact disk 45, the pump housing 2 is constructed in two parts and comprises a flange 53 bordering the shaft inlet opening 15. Such a flange is also to be provided in the other embodiments, especially if the size of the shaft inlet opening 15 does not permit passage of the pump cam 7.

The housing-side raceway for the needle bearing 42 arranged on the rear housing wall 20 is formed by a specially shaped, thin-walled inner ring 22*d* drawn onto the bearing journal 19. Starting from its inner raceway for the needles 27 of the radial needle bearing 24 constructed, in turn, as a needle assembly 25, this has a diameter increasing in steps in the direction of the rear housing wall 20. Here, the inner raceway transitions into a shoulder 54 that is used with its annular end face 55 facing away from the rear housing wall 20 as an axial contact surface for the cage 26 of the needle assembly 25 and that centers the cage 43 of the axial needle bearing 42 with its external lateral surface 56. Furthermore, the shoulder 54 transitions into a collar 57 extending outward in the radial direction between the rear housing wall 20 and the annular end face 41 of the drive shaft 3*g*. The needles 44 of the axial needle bearing 42 roll on this collar. In addition, on its end opposite the collar 57, the inner ring 22*d* has a flange 58 that extends inwardly in the radial direction and that grips over the end of the bearing journal 19 and that is used as an engagement surface for an assembly tool for pushing the inner ring 22*d* onto the bearing journal 19.

Figure 7:
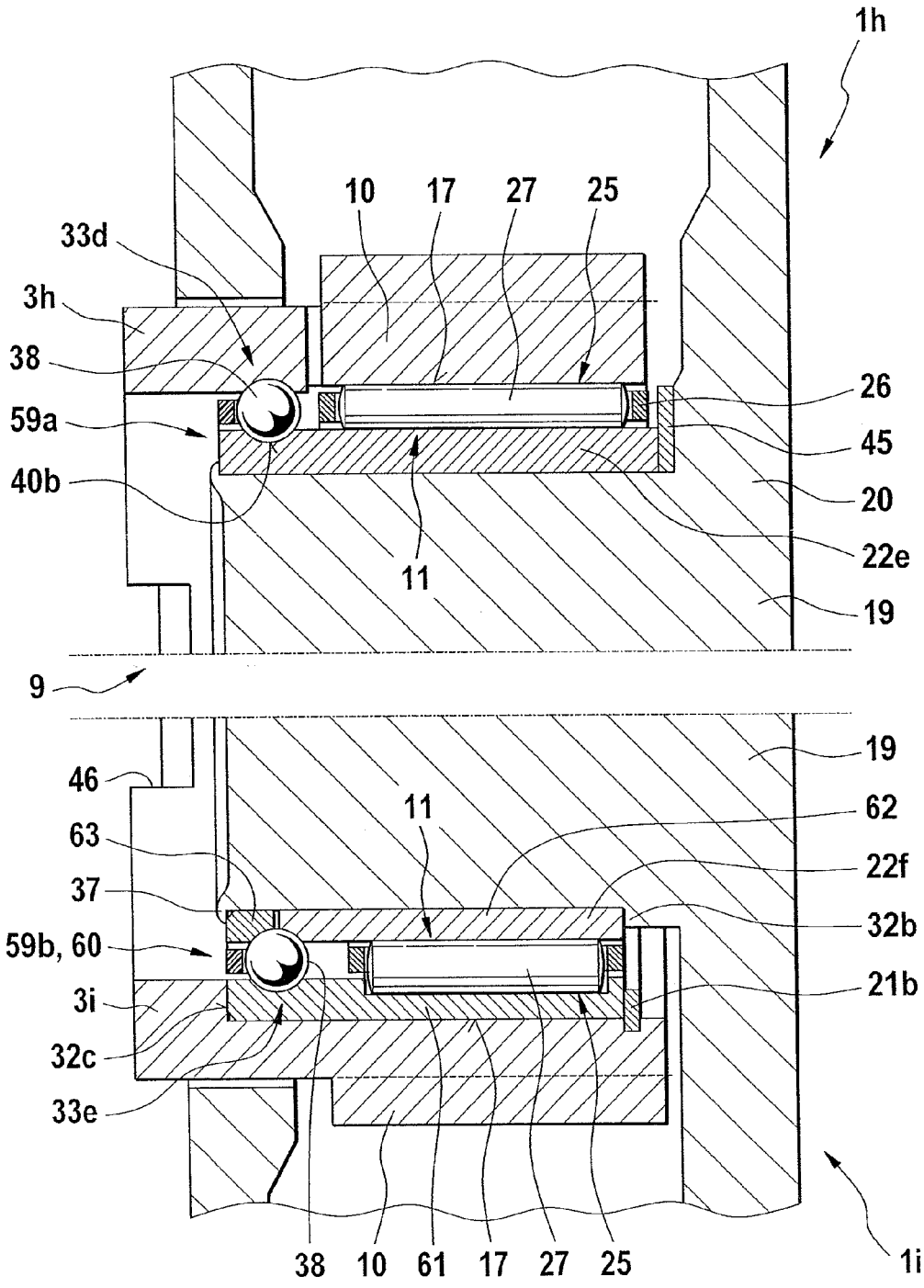
FIG. 7 is a longitudinal section view through a piston pump according to the invention according to an eighth and a ninth embodiment, each cut in half.

In FIG. 7, other embodiments of the piston pumps 1*h* and 1*i* according to the invention are shown with drive shafts 3*h* and 3*i* and the associated bearings 11 each in an upper and a lower half section. Each drive shaft 3*h* and 3*i* has the continuous longitudinal opening 9 and two diametrically opposite rectangular recesses 46 for receiving the mentioned double D flats coupling. For two constructions, the bearings 11 arranged between the hollow cylindrical section 10 and the bearing journal 19 comprise a combined radial-axial bearing 59*a* or 59*b* each made from the needle assembly 25 and an axial roller bearing 33*d* or 33*e* constructed as an angular contact ball bearing for supporting axial forces applied from two sides. In the radial-axial bearing 59*a* according to the upper half section, a formed inner ring 22*e* drawn onto the bearing journal 19 is provided. The contact disk 45 inserted between the inner ring 22*e* and the rear housing wall 20 is used as an axial contact surface for the cage 26 of the needle assembly 25, wherein the needles 27 roll directly on the internal lateral surface 17 of the hollow cylindrical section 10. The inner raceway for the balls 38 of the angular contact ball bearing is formed by a peripheral groove 40*b* of the inner ring 22*e*, while its outer raceway also runs on the internal lateral surface 17 of the hollow cylindrical section 10.

Accordingly, the radial-axial bearing 59*b* shown in the lower half section is combined to form a component 60 produced separately from the drive shaft 3*i* and the bearing journal 19. This component 60 also designated as a combined needle bearing comprises an outer ring 61 inserted into the internal lateral surface 17 of the hollow cylindrical section 10 for forming the outer raceways for the needles 27 of the needle assembly 25 and the balls 38 of the angular contact ball bearing. An inner ring 22*f* forming the inner raceways for the needles 27 and the balls 38 is divided in two for supporting axial forces applied from two sides with a wide and a narrow section 62 and 63. The component 60 is fixed on the housing side by the end flattening 37 and also the step 32*b* of the bearing journal 19 and on the shaft side by a shoulder 32*c* and the shaft-side securing ring 21*b*.

Someone skilled in the art can obtain additional information and also suggestions for shaping and dimensioning the bearings in appropriate bearing catalogs, for example, in the "roller bearing" catalog of the company Schaeffler KG, January 2006 edition. Finally, in this connection, it should also be mentioned that according to the magnitude of the radial force, instead of the needle assembly, the radial needle bearing could also have a full-type construction without a cage for increasing the load rating.

LIST OF REFERENCE SYMBOLS

1*a-i* Piston pump
2 Pump housing
3*a-i* Drive shaft
4 Plunger guide
5 Pump plunger
6 Cam roller
7 Pump cam
8 Cam reference circle
9 Longitudinal opening
10 Hollow cylindrical section
11 Bearing
12 Internal longitudinal teeth
13 External longitudinal teeth
14*a-c* Shaft inlet opening
15 Shaft inlet opening
16 Sealing ring
17 Internal lateral surface of the hollow cylindrical section
18 External lateral surface of the bearing journal
19 Bearing journal
20 Rear housing wall
21*a,b* Securing ring
22*a-f* Inner ring
23 Needle sleeve
24 Radial needle bearing
25 Needle assembly
26 Cage of the radial needle bearing
27 Needles of the radial needle bearing
28 Outer ring
29 Shoulder
30 Borehole
31 Bearing
32*a-c* Step
33*a-e* Axial roller bearing
34 Internal lateral surface of the outer ring
35 Radial force
36 Shoulder
37 Flattening
38 Ball
39 Outer lateral section of the drive shaft
40*a, b* Peripheral groove
41 Annular end surface of the drive shaft
42 Axial needle bearing

43 Cage of the axial needle bearing
44 Needles of the axial needle bearing
45 Contact disk
46 Rectangular recess
47 Shoulder
48 Shoulder
49 Bearing
50 Axial needle bearing
51 Internal wall section of the pump housing
52 Annular end surface of the drive shaft
53 Flange
54 Shoulder
55 Annular end surface of the inner ring
56 Outer lateral surface of the shoulder
57 Collar
58 Flange
59*a, b* Radial-axial bearing
60 Component
61 Outer ring
62 Wide section
63 Narrow section

The invention claimed is:

1. Piston pump for supplying high-pressure fuel to a direct-injection internal combustion engine, comprising a pump housing and a drive shaft for activating at least one pump plunger that is oriented in a radial direction in the pump housing relative to the drive shaft, wherein the drive shaft is rotatably mounted by at least one bearing that extends between a shaft inlet opening of the pump housing and a rear housing wall opposite the shaft inlet opening, the at least one bearing extends between an internal lateral surface of a hollow cylindrical section of the drive shaft and an external lateral surface of a bearing journal starting from the rear housing wall and extending into the hollow cylindrical section, the drive shaft is rotationally connected coaxially to a camshaft used for activating intake or exhaust valves of the internal combustion engine, wherein the drive shaft has a continuous longitudinal opening, wherein the hollow cylindrical section and internal longitudinal teeth adjacent to the hollow section extend in the longitudinal opening, wherein the internal teeth engage with external longitudinal teeth on an end section of the camshaft facing the piston pump.

2. Piston pump according to claim 1, wherein the at least one bearing and the at least one pump plunger are positioned axially aligned relative to each other so that a radial force of the at least one pump plunger supported by the at least one bearing extends without mechanical advantage within a longitudinal extent of the at least one bearing.

3. Piston pump according to claim 1, wherein the bearing journal is constructed integrally with the pump housing.

4. Piston pump according to claim 1, wherein the drive shaft is rotationally connected coaxially to a camshaft used for activating intake or exhaust valves of the internal combustion engine.

5. Piston pump according to claim 4, wherein the drive shaft and the camshaft are assembled into a rigidly connected component.

6. Piston pump according to claim 1, wherein the drive shaft is made from a hardened roller bearing steel of the types C16, 16MnCr5, C45, Cf53, C80, or 100Cr6.

7. Piston pump according to claim 1, wherein the at least one bearing comprises at least one radial needle bearing comprising a needle assembly with a cage and needles guided therein.

8. Piston pump according to claim 7, wherein the at least one bearing comprises a radial-axial bearing with the needle assembly and with an axial roller bearing that is arranged adjacent to the needle assembly and that is constructed as an angular contact ball bearing, wherein the radial-axial bearing is combined into a component produced separately from the drive shaft and the bearing journal.

9. Piston pump according to claim 7, wherein the at least one bearing comprises a radial-axial bearing with the needle assembly and with an axial roller bearing arranged adjacent to the needle assembly and is constructed as an angular contact ball bearing, wherein the internal lateral surface of the hollow cylindrical section of the drive shaft is used as an outer raceway for the balls and as an outer raceway for the needles.

10. Piston pump according to claim 7, wherein an internal lateral surface of the hollow cylindrical section of the drive shaft is used as an outer raceway for the needles.

11. Piston pump according to claim 10, wherein the outer raceway is bounded on one side or two sides by one or two shoulders that extend inwardly in the radial direction and that are constructed integrally with the drive shaft and that are used as axial contact surfaces for the needles.

12. Piston pump according to claim 7, wherein the radial needle bearing is constructed as a needle sleeve with a thin-walled outer ring that is inserted into the internal lateral surface of the hollow cylindrical section of the drive shaft, wherein the outer ring has an internal lateral surface used as an outer raceway for the needles and also two shoulders used as axial contact surfaces for the cage.

13. Piston pump according to claim 12, wherein the needle sleeve and the thin-walled inner ring form a component, in that the outer ring of the needle sleeve is surrounded in the axial direction by two shoulders extending outwardly in the radial direction and constructed integrally with the inner ring.

14. Piston pump according to claim 7, wherein an inner raceway for the needles is formed by an inner ring drawn onto the external lateral surface of the bearing journal.

15. Piston pump according to claim 14, wherein the inner ring has a thin-walled construction and two shoulders extending outwardly in the radial direction and act as axial contact surfaces for the cage.

16. Piston pump according to claim 14, wherein for the purpose of securing the inner ring in the axial direction on the bearing journal there is an end flattening of the bearing journal directed outwardly in the radial direction, wherein the flattening at least partially covers the inner ring in the radial direction.

17. Piston pump according to claim 14, wherein the inner ring has a thin-walled construction and, starting from the inner raceway for the needles of the radial needle bearing, has a diameter increasing in steps in the direction of the rear housing wall such that the inner raceway transitions into a shoulder that is used having an annular end face facing away from the rear housing wall as an axial contact surface for the cage of the radial needle bearing and that centers the cage of the axial needle bearing with an external lateral surface thereof and the shoulder transitions into a collar that extends outwardly in the radial direction between the rear housing wall and the annular end surface of the drive shaft and that is used as a housing-side raceway for the needles of the axial needle bearing.

18. Piston pump according to claim 17, wherein the inner ring has on its end opposite the collar a flange extending inwardly in the radial direction and gripping over an end of the bearing journal.

19. Piston pump for supplying high-pressure fuel to a direct-injection internal combustion engine, comprising a pump housing and a drive shaft for activating at least one pump plunger that is oriented in a radial direction in the pump housing relative to the drive shaft, wherein the drive shaft is rotatably mounted by at least one bearing that extends between a shaft inlet opening of the pump housing and a rear housing wall opposite the shaft inlet opening, the at least one bearing extends between an internal lateral surface of a hollow cylindrical section of the drive shaft and an external lateral surface of a bearing journal starting from the rear housing wall and extending into the hollow cylindrical section, wherein the at least one bearing comprises two bearings for the drive shaft are provided, wherein the second bearing comprises an axial roller bearing.

20. Piston pump according to claim 19, wherein the axial roller bearing is constructed as a ball bearing arranged in the shaft inlet opening of the pump housing, wherein an inner raceway for the balls is formed by a peripheral groove on an external lateral section of the drive shaft extending in the shaft inlet opening.

21. Piston pump according to claim 19, wherein the axial roller bearing is constructed as the axial needle bearing comprising a cage and needles guided therein and is arranged between the rear housing wall and an annular end surface of the drive shaft facing the rear housing wall.

22. Piston pump according to claim 21, wherein another axial needle bearing is arranged between an inner wall section of the pump housing bounding the shaft inlet opening and an annular end surface of the drive shaft facing the inner wall section.

23. Piston pump for supplying high-pressure fuel to a direct-injection internal combustion engine, comprising a pump housing and a drive shaft for activating at least one pump plunger that is oriented in a radial direction in the pump housing relative to the drive shaft, wherein the drive shaft is rotatably mounted by at least one bearing that extends between a shaft inlet opening of the pump housing and a rear housing wall opposite the shaft inlet opening, wherein at least one borehole passing transverse through the drive shaft is provided that opens in a region of the at least one bearing and is used as a lubricant channel, the at least one bearing extends between an internal lateral surface of a hollow cylindrical section of the drive shaft and an external lateral surface of a bearing journal starting from the rear housing wall and extending into the hollow cylindrical section and the at least one pump plunger is axially aligned with the at least one bearing and the bearing journal.

* * * * *